United States Patent [19]

Nelson

[11] 3,995,611

[45] * Dec. 7, 1976

[54] FIREPLACE HEATING CHANNEL

[76] Inventor: Clifford H. Nelson, 9 Merry Point Terrace, Newport News, Va. 23606

[ * ] Notice: The portion of the term of this patent subsequent to July 29, 1992, has been disclaimed.

[22] Filed: Dec. 18, 1975

[21] Appl. No.: 641,725

[52] U.S. Cl. ..... 126/121; 126/129; 126/131

[51] Int. Cl.[2] ..... F24B 7/04

[58] Field of Search ..... 126/121, 128, 129, 130, 126/131; 239/51

[56] References Cited

UNITED STATES PATENTS

| | | | |
|---|---|---|---|
| 1,740,996 | 12/1929 | Muir | 126/121 |
| 2,161,723 | 6/1939 | Rutland | 126/121 |
| 2,362,526 | 11/1944 | Austin | 126/121 |
| 2,494,527 | 1/1950 | Walters | 126/121 |
| 3,896,785 | 7/1975 | Nelson | 126/121 |

*Primary Examiner*—Kenneth W. Sprague
*Assistant Examiner*—Larry I. Schwartz

[57] ABSTRACT

This invention is designed to increase the heating efficiency of a conventional type fireplace. The fireplace heating channel consists of a hollow metal air conveying channel which is designed to fit closely against the multiple inside walls of a conventional fireplace in combination with a hollow metal flame guide vane that connects the upper inside portions of the side arms of the air channel. The flame guide vane is triangular in cross section and positioned horizontally and forward of the center panel of the air conveying channel so as to form a suitable passageway for the hot ascending fire gases. The entire assembly is moved upward during installation by means of vertically adjustable legs so as to position the horizontal base of the flame guide vane against the horizontal arch of a conventional fireplace thereby forcing the room air to enter the fire below the apex of the flame guide vane. This reduces the flow of excess room air up the chimney and, in addition, so directs the flow of incoming room that the rising fire gases are constrained to move upward against the center channel, thereby promoting the transfer of fire heat to the fireplace heating channel. The channel and flame guide vane are heated by the fire and room air is forced to make multiple horizontal passes through the fireplace heating channel. The heated room air being vented back into the room. The device is free standing and is also readily insertible in a conventional fireplace and does not require modification to the fireplace structure and does not interfere with its normal functioning. Because of these features the device is compatible with a broad range of fireplace sizes and types.

7 Claims, 5 Drawing Figures

FIREPLACE HEATING CHANNEL

DESCRIPTION OF PRIOR ART

Presently on the market are various devices that use a fireplace to heat the room air by circulation. These designs involve a metal structure that is placed inside a fireplace. The heating of room air is usually achieved by circulation of room air through the device. The direction of this circulating air is mainly vertical. In a departure from prior art this invention employs multiple horizontal passes of air flow to heat the room air. In addition to being an efficient extractor of heat from the fireplace, this invention has a minimum impact on the original appearance and decor of the fireplace. Other novel features include a unique flame guide vane that recovers radiation normally lost up the chimney, reduces room air losses to the chimney, has means of increasing transfer of heat from the fire to the subject device, and when compared to prior art this invention conserves and reduces the use of electrical power.

BACKGROUND OF THE INVENTION

Our nation is currently faced with a projected shortage of energy derived from gas and fuel oil. This invention is directed toward reducing the use of these shortage fuels for heating individual houses.

Many American houses have fireplaces that could burn alternate fuels such as wood, coal and other combustibles, but because the efficiency of the conventional fireplace is low, use as an alternate heating source is marginal.

The Fireplace Heating Channel meets this need and transforms what has traditionally been primarily a decorative feature of the house into a more efficient generator of useful heat.

SUMMARY OF THE INVENTION

The Fireplace Heating Channel consists of a metal air conveying channel designed to fit closely against the multiple inside walls of an existing fireplace and equipped with a flame guide vane. The channel and vane are heated by the fire. Room air makes multiple horizontal passes through the fireplace heating channel and at option through the vane. A blower or natural convection forces may be used to induce room air flow through the subject heating channel. The heated room air is vented back into the room, yielding a substantial increase in the overall heat output from the fireplace.

The installation of the device does not interfere with the normal functioning of the existing fireplace and requires no modification of the basic structure.

Cross Reference To A Specifically Related Patent

This application pertains to improvements to my U.S. Pat. No. 3,896,785 issued July 29, 1975 to Clifford H. Nelson.

Detailed Description Of The Invention

Figure 1:
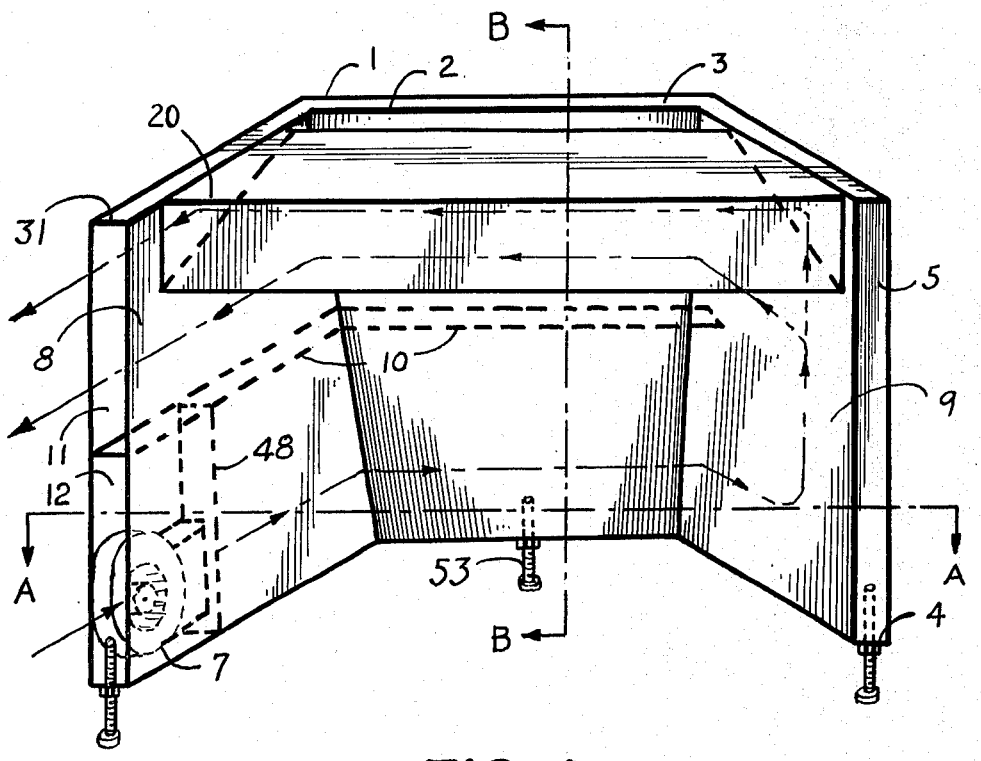
FIG. 1 is a schematic drawing of the preferred embodiment of the invention illustrating the three-sided air channel and the flame guide vane.

FIG. 1 illustrates the principle embodiment of the invention, a free standing air channel 31 and flame guide van 20 designed to efficiently heat room air flowing through the channel 31 and the vane 20. The air channel 31 is made of metal. It is an air conveying channel 31 designed to be insertible into an existing coventional fireplace without requiring modification to the basic fireplace structure. The air channel 31 shown in FIG. 1 has three sides 8, 9, 2, which fit against the three inside fireplace walls. The air channel 31 is U shaped, having a back 2, a left forward facing arm 8, and a right forward facing arm 9. The right arm is shorter than the left arm 8. The front surface 2 of the channel 31 is separated from the back surface 1 by spacers 3, 4, 5. The spacers 3, 4, 5 are joined to the front 2 and back surface in a manner to form air tight joints to prevent the entry of fire smoke and or the venting of room air from the channel 31.

The guide vane 20 extends from the upper portion of left arm 8 to right arm 9 and forms an air tight passage for room air between the two arms. The flame guide vane 20 is positioned so as to form a converging passageway for hot gases between it and the front surface 2 of the air channel and constructed wide enough to block the remainder of the fireplace throat, forcing the exhaust gases to flow through the upward converging passage. The flame guide vane 20 is hollow and triangular, or other suitable shape, in cross-section and made of metal. Three adjustable legs 53 are used to raise the entire heating assembly against the existing fireplace arch to block off the flow of excess room air to the chimney. The blower 7 directs the flow of room air into the lower horizontal air passage 12 of the air channel 31. The baffle 10 indicated by dotted lines separates the left arm 8 and the back channel into two air passages, one upper 11 and one lower 12. The right arm 9 does not contain a baffle 10. The dot and dash line of FIG. 1 indicates the route followed by the flow of air in making two horizontal passes through the air channel 31. The room air enters the lower passage at 12 and when it reaches the right arm 9 is divided into two streams. One stream, indicated by a single dot and dash line, follows the upper passage of the air channel 31 and emerges at exit opening 11. The other stream, indicated by a double dot and dash line, passes horizontally through the flame guide vane 20 and also emerges at exit 11. When the air channel 31 and vane 20 are heated by a fire, radiant and fuel gas energy raises the temperature of the room air flowing through the air channel 31 and vane 20 which is returned to the room as useful heated air. In addition the heated surfaces of the guide vane and channel, that face the room, radiate heat energy into the room.

The air channel in combination with the guide vane is designed to increase the heat efficiency in serveral ways, thus providing an advancement over prior art, such as, (a) forming a converging passage to increase the transfer of heat from the hot ascending fuel gases to both the top portion of the center panel of the air channel 31 and the opposing inside surface of the guide vane 20 facing the center panel, (b) impede and greatly reduce the loss of excess room air up the chimney, which is a major source of heat enregy loss, as the upper horizontal base of the triangular guide vane 20 is wide enough to block the fireplace throat leaving only a converging passageway for hot fuel gases to the rear, (c) guide vane is designed to intercept, utilize and make available to the room a large portion of the heat radiation emanating upward from the fire to avoid its direct loss up the chimney throat, (d) because the downward facing apex of the triangular cross-sectioned guide vane 20 is much lower than the brick fireplace arch, most of the room air is forced to enter the fire more nearly at the combustion level where it is needed and the flow of undesired and excess room air is further reduced so as to increase the overall heat recovery from the fire, additionally the forward position of the downward facing apex together with the upward slope of the inside surface of the guide vane 20 to the exhaust slot, creates an aerodynamic design configuration that strongly opposes any tendency for the fireplace heating unit to release smoke into the room, in fact if the original fireplace has a tendency to smoke the introduction of the subject Fireplace Heating Channel will cure the problem in most cases, (e) The top horizontal surface of the guide vane is covered with heat insulating material to reduce loss of heat up the chimney, (f) the horizontal passes of circulating air through the center panel of the air channel represent an advancement over prior art, which employ a vertical partition in the center panel causing dead air spaces to be created by the circulating room air on each side of the vertical baffle, both in the upper and lower portions thereof, resulting in reduced transfer of heat energy to the circulating air. In contrast the horizontal passes of the air in the subject device enhances the transfer of heat to the circulating room air, in this center and hottest panel of the air channel, by eliminating dead air spaces, (g) with horizontal baffling, only one room air blower is required for air circulation as opposed to the two used in prior art resulting in conservation and reduced use of electrical power for operating the fireplace.

Figure 2:
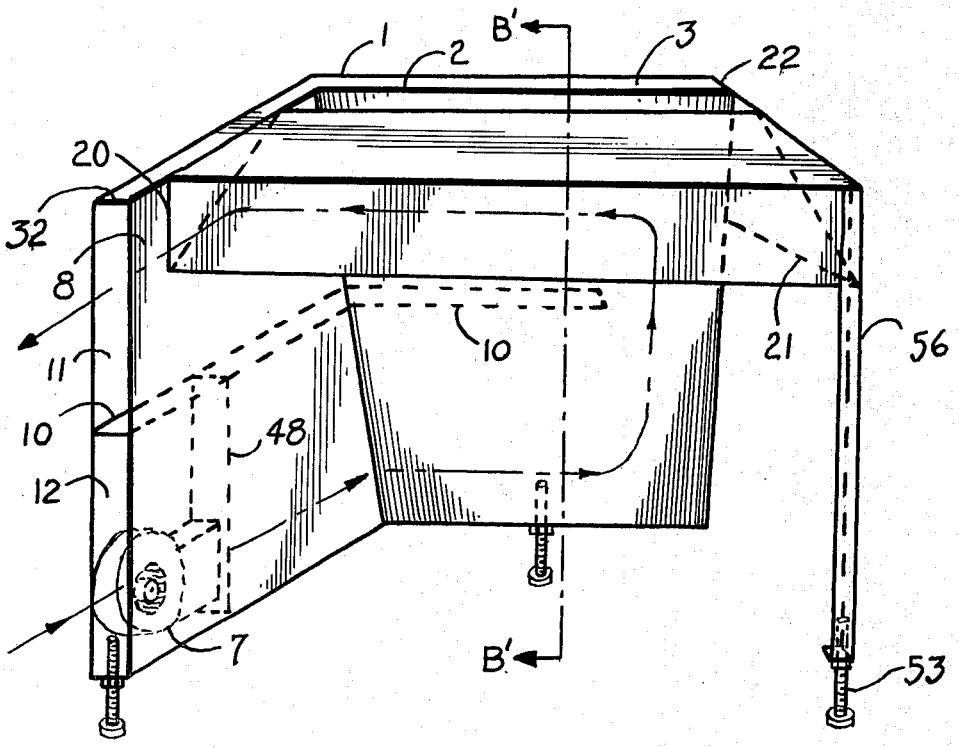
FIG. 2 is a schematic drawing of a simplified heating channel with only two adjoining sides and a flame guide vane.

FIG. 2 is a schematic drawing of a simplified heating channel 32 with only two adjoining sides. It is similar in function to the air channel 3 shown in FIG. 1 but with the right arm 9 omitted. The channel 32 is sealed off with an end piece 32 at the place where the right arm 9 was attached as shown in FIG. 1. The baffle 10 has been shortened and does not extend all the way to the end piece 22. The room air flow route is indicated by the dot dash line, originating at blower 7, entering lower passage 12 and turning upward to pass between the end piece 22 and the shortened baffle 10 and then flowing back along the upper passage for exit through opening 11. The flame guide vane 20 functions are as described in FIG. 1, except, that it does not have provision for room air to flow through it and accordingly its temperature increases providing more radiation energy to the room. The left end of the guide vane 20 is simply fastened to the inside of left arm 8 and the other end is supported by bracket 21. The bracket 21, in turn, is fastened to end piece 22. A forward support leg is fastened to the support bracket 21 and vane 20. An adjustable support pad 53 is fastened to the lower part of leg 56. All three pads 53 are used to raise the heating assembly against the existing fireplace arch to block off excess room air flow. Other features are similar to those described in FIG. 1.

Figure 3:
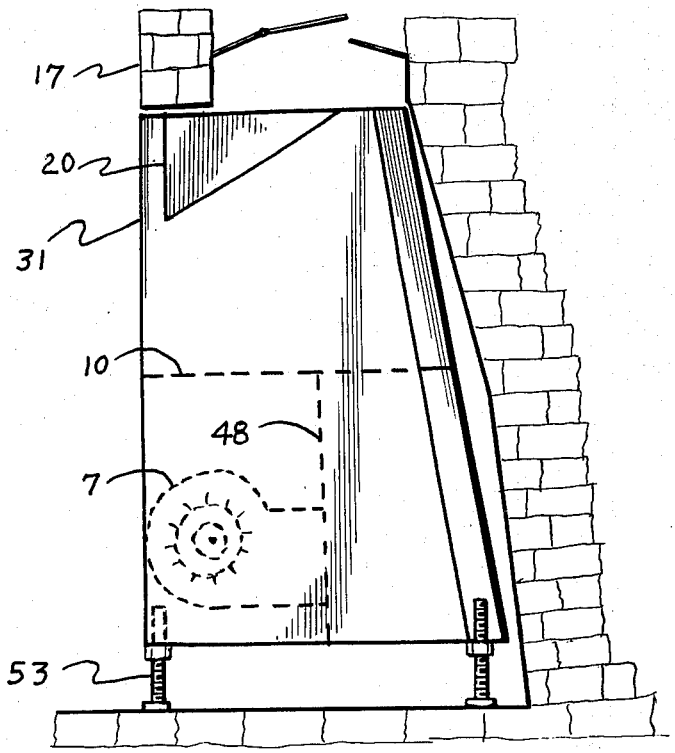
FIG. 3 is a schematic drawing of the cross-sections B-B and B′—B′ of FIG. 1 and FIG. 2.

FIG. 3 is a schematic drawing of the cross-section B—B and B′—B′ of FIGS. 1 and 2. The Fireplace Heating Channel 31 and guide vane 20 are shown almost in contact with the existing fireplace arch. The three adjustable legs 53 are used to raise the heating assembly so as to be in firm contact with the underside of the existing arch 17 to block off the flow of excess room air over the top of the guide vane 20. Room air must therefore enter the fire below the lower apex of the vane 20 where it is needed to promote effective combustion and burning. This configuration greatly reduces the tendency of the fireplace to release undesirable smoke into the room, thus representing a major improvement over prior art. This view also shows the partition 48 to which the blower 7 is attached so as to provide forced room air circulation through the heating channel assembly 31.

Figure 4:
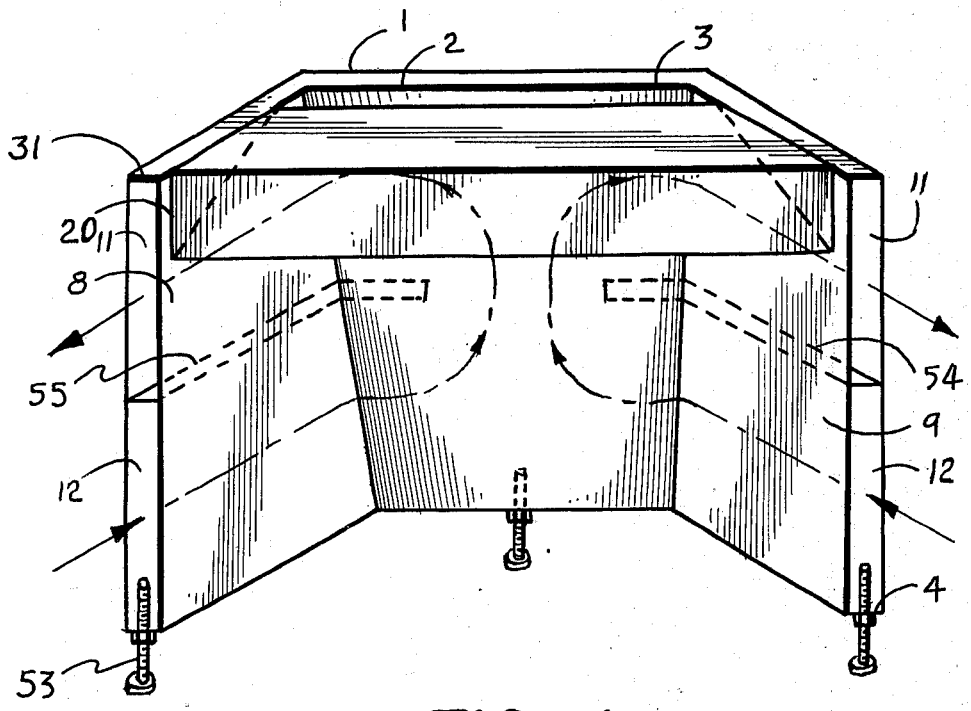
FIG. 4 is a schematic drawing of a free standing air channel and a flame guide vane. This configuration does not use a blower but instead, through the use of a unique baffle design, employs the natural convective force of heated air to induce room air to circulate through the heating channel.

FIG. 4 is a schematic drawing of a free standing air channel 31 equipped with a guide vane 20. This fireplace heating channel 31 does not use a blower to force room air to circulate through the channel 31, instead it employs the natural convective force of heated air to induce the room air to circulate through the channel. Two baffles 54 and 55 are used to form four room air passageways, two upper 11 and two lower 12. The assembly is constructed symmetrically with a gap between the inner ends of the baffles 54 and 55. As the hottest portion of the channel 31 is the middle area of the rear channel 2, a chimney effect is created in the middle area of the rear channel by the heating of room air in contact with this hot center channel. As this heated room air is less dense than the outside room air, it rises and induces the cold room air to enter the lower passageways 12 and exit from the upper passageways 11 providing two streams of heated air into the room. This circulation of room air through the channel 31 is indicated by the dot and dash lines. Three adjustable legs are used to position the channel 31 assembly against the underside of the existing fireplace arch to block off the flow of excess room air up the chimney. Prior art used a vertical partition in the center of the rear channel which created a dead air space on each side of the partition and reduced the convective transfer of heat from the channel assembly to the circulating room air. This simplified configuration eliminates the vertical partition and increases the efficiency of operation over prior art by eliminating the said dead air spaces. The guide vane 20 reduces the flow of excess room air up the chimney and also forms an upward converging passageway for hot fire gases that increases the temperature of the rear channel surface, and reduces the tendency to release undesired fire smoke into the room. These aforesaid advantages of the guide vane 20 and use of natural convective forces to promote room air circulation, establish an advancement over prior art by yielding greater overall efficiency. By not using a blower, the requirement for electricity is eliminated thus further conserving energy which is currently in short supply in America.

Figure 5:
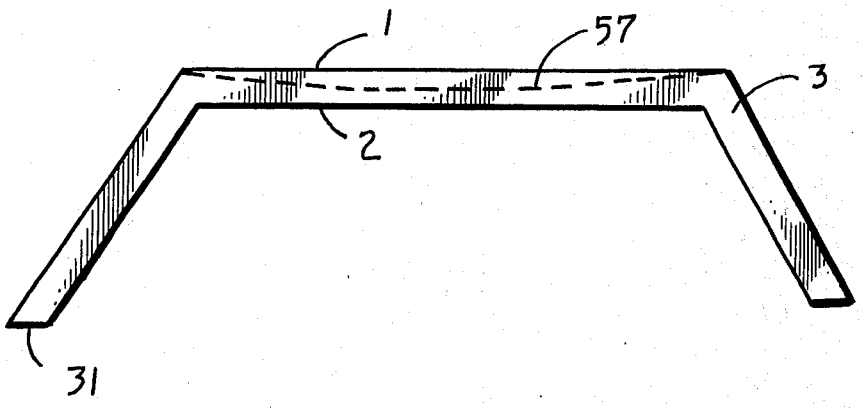
FIG. 5 is a schematic drawing of cross-section A—A of FIG. 1, illustrating an improved shape of the rear surface of the center air channel.

FIG. 5 is a schematic drawing of cross-section A—A of FIG. 1, showing the air channel 31 with its front surface 2 and rear surface 1. An alternate shape of the cross-section of the center air channel is shown by dotted lines 57. As the middle of the center front panel 2 is the hottest area of the air channel, it is advantageous to increase the velocity of room air flow over this hot surface region. By constricting the width of the air channel over this central hot region, a significant increase in convective heat transfer is achieved. This improved shape of the rear surface 1 of the channel shown by the dotted line 57 represents an advancement over prior art and yields higher efficiency of operation for the Fireplace Heating Channel.

Even though the invention has been described specifically relative to features such as; cross-sectional shape of the air channel back, air passage configurations, locations of the room air entry and exit passages, the location, shape and size of the left and right arms of the air channel, means of forcing air flow through the channel, the use of insulation, and the shape and location of the flame guide vane, it is to be understood that these features of the invention are the preferred embodiments only. There are many modifications and variations to the several features of the present invention that can be made, all without departing from the spirit or scope of the invention as is defined in the following claims:

I claim:

1. A free standing fireplace heating channel comprising a hollow metal air conveying channel in combination with a flame guide vane, insertible into an existing conventional fireplace without requiring modification to the fireplace structure, said channel having a center panel and at least one forward facing channel arm adapted to fit against multiple inside walls of a fireplace, said channel having adjoining walls exposed to the heat from the fire with corresponding rear walls spaced therefrom and connected by spacer means so as to form a suitable air channel for conveying room air to be heated by the fire, means for forcing room air into a lower portion of said forward facing channel arm by a single blower located therein, and baffle means to direct the forced circulating room air to make multiple horizontal passes through said channel prior to exiting back into a room from an upper portion of a forward facing channel arm as useful heating air, said flame guide vane being attached to an upper inside portion of said forward facing arm of said air channel and extending horizontally to a symmetrical position on an opposite side, said flame guide vane having a triangular cross-section with the base horizontal and the apex pointing downward toward the fire and positioned forward of the center panel of the air channel so as to form an upward converging passageway for the hot fire gases, said passageway being formed by the upper portion of a near vertical surface of the center panel and the opposing rearward slanting surface of the flame guide vane wherein the width of the horizontal base of the guide vane is constructed wide enough to extend to the fireplace front such that by means of the vertically adjustable legs the said horizontal base can be brought in contact with the existing fireplace arch to block off the flow of excess room air.

2. A fireplace heating channel as in claim 1, wherein the air channel equipped with a flame guide vane has three sides adapted to fit against the three inside walls of the fireplace.

3. A fireplace heating channel equipped with a flame guide vane as in claim 1, wherein a three sided air channel having first and second forward facing channel arms is adapted to fit against the three inside walls of an existing fireplace, wherein the three sided air channel has one horizontal baffle means that divides the first forward facing channel arm into an upper and lower air passageway and said baffle means is extended to also divide the rear or center panel of said channel into corresponding passages, such that room air enters the bottom portion of the first forward facing channel arm and then flows through the lower passageway of said center panel and turns upward and reverses flow in the second channel arm and subsequently returns to a room via the upper passageway so formed by the baffle means, further, said flame guide vane being fastened symmetrically to the inside walls of upper portions of the first and second forward facing channel arms, said flame guide vane having a hollow interior vented into the hollow interior of said channel arms at the point of attachment whereby said vane becomes an additional conveying channel for heating circulating room air.

4. A fireplace heating channel as in claim 1, wherein the air channel equipped with a flame guide vane, has two adjoining sides adapted to fit against two of the three inside walls of a fireplace.

5. A fireplace heating channel equipped with a flame guide vane as in claim 1, wherein a two sided air channel has one baffle means to obtain two horizontal passages for heating room air and one forward support leg and bracket means located oppositely from the forward facing channel arm.

6. A fireplace heating channel equipped with a flame guide vane as in claim 1, wherein the center air channel is not uniform in cross-section or width whereby the shape of the rear surface of said center channel is altered to decrease the spacing or separation of the said center channel walls over the middle vertical portion of said center channel thereby increasing the room air flow velocity in said middle region of the center channel.

7. A free standing fireplace heating channel comprising a hollow metal three sided air conveying channel in combination with a flame guide vane, insertible into an existing conventional fireplace without requiring modification to the fireplace structure, the fireplace heating channel assembly equipped with vertically adjustable legs for upward positioning during installation, wherein the three sided air channel has symmetrical forward facing arms connected to a center channel and each arm is equipped with a baffle means for dividing the arm into a upper and lower passageway for room air flow and said baffle means extending partway into the center panel so as to leave a gap in the middle portion of the center channel for the flow of circulating room air, the heating channel and flame guide vane being heated by the fire induces a convective flow of room air through the heating channel, with the cold air entering the lower passageway of said arms and exiting in the upper passageway of said arms, said flame guide vane being symmetrically attached to the upper portion of the inside surfaces of the two forward facing arms, said flame guide vane having a triangular cross section with the base horizontal and the apex pointing downward toward the fire and positioned forward of the center panel of the heating channel so as to form an upward converging passageway for the hot fire gases, said passageway being formed by the upper portion of the near vertical surface of the center panel and the opposing rearward slanting surface of the flame guide vane wherein the width of the horizontal base of the flame guide vane is constructed wide enough to extend to the fireplace front such that by means of the vertically adjustable legs the said horizontal base can be brought upward in contact with the existing fireplace arch to block off the flow of excess room air.

* * * * *